United States Patent [19]

Vollhardt

[11] Patent Number: 4,913,064

[45] Date of Patent: Apr. 3, 1990

[54] DEVICE FOR INCINERATING WASTE MATERIAL

[75] Inventor: Frohmut Vollhardt, Oberhausen, Fed. Rep. of Germany

[73] Assignee: MAN Gutehoffnungshuette GmbH, Oberhausen, Fed. Rep. of Germany

[21] Appl. No.: 305,279

[22] Filed: Feb. 1, 1989

[30] Foreign Application Priority Data

Feb. 3, 1988 [DE] Fed. Rep. of Germany ..... 3803096
Feb. 17, 1988 [DE] Fed. Rep. of Germany ..... 3804853

[51] Int. Cl.[4] ..... F23G 5/12; D06F 75/00

[52] U.S. Cl. ..... 110/229; 110/230; 110/226; 110/246

[58] Field of Search ..... 110/229, 230, 226, 246; 48/209

[56] References Cited

U.S. PATENT DOCUMENTS 3,716,339 2/1973 Shigaki et al. ..... 110/226
3,818,869 6/1974 Blaskowski ..... 110/229
4,656,955 4/1987 Kuo ..... 110/226
4,840,129 6/1989 Jelinek ..... 110/229

*Primary Examiner*—Henry A. Bennet
*Assistant Examiner*—Denise L. Ferensic
*Attorney, Agent, or Firm*—McGlew & Tuttle

[57] ABSTRACT

This invention relates to a plant and arrangement and method for the low temperature carbonization of waste material with low-temperature carbonization device and a secondary incineration chamber. The heating system of the low-temperature carbonization device is substantially corrosion-free and gases hazardous to the environment are transformed into gases with a lower level of hazardous matter in a simple manner by directing the heating gas of the low-temperature carbonization device into a closed loop cycle through a low temperature carbonization device and into a heat exchanger of a secondary incineration device. The heat exchanger is equipped with a lining which insures a temperature of the burner gases in the heat exchanger of 1200° C. or more for a period of dwell of 1 to 5 sec.

6 Claims, 2 Drawing Sheets

DEVICE FOR INCINERATING WASTE MATERIAL

FIELD AND BACKGROUND OF THE INVENTION

This invention relates in general to waste disposal and in particular to a new and useful plant arrangement for a low temperature carbonization of waste materials.

Waste materials according to the invention include household waste and industrial waste as well as chemical residues developing noxious matter or hazardous substances such as various dioxines, furanes, CO etc.

Plants and arrangements for the incineration of harmful waste are in use by the present invention as a signal, wherein a revolving tubular furnace is followed by a secondary incineration chamber. This incineration chamber has a temperature between 1200° and 1400° and a gas velocity of 2–4 m/sec.

A secondary incineration chamber downstream of the incineration furnace for chemical waste is known from German DE-Patent Application No. 36 25 397, which has not been pre-published. Herein the burners in the secondary incineration chamber are concentrated in a certain area of the chamber.

The German Patent Application No. P 37 30 339, which is also older and gas not pre-published either, suggests a plant arrangement for the low-temperature carbonization of waste materials and contaminated matter, wherein an extractor for residues from a low-temperature carbonization drum is followed by a step grate equipped with an incineration means which in turn is followed by a secondary incineration chamber and a heat-recuperation device, preferably a waste heat boiler with a steam collecting drum. In these systems and devices the incineration or carbonization gases enter the secondary incineration chamber as a heat dissipating medium This is also possible in the plant or arrangement according to the invention. However, the incineration gases may also be from a different source.

The invention provides a heating system for a low-temperature carbonization plant which is substantially free from corrosion and furthermore permits the transformation of gases hazardous to the environment into those with a reduced content of hazardous matter and to achieve this by means which are simple in design.

The arrangement according to the invention guarantees that the gases charged with hazardous matter entering the secondary incineration chamber at a temperature of ca. 1400° are kept at a temperature of 1200° or above during their period of dwell of 1.0 to 5.0 sec., preferably 2 sec., so that during this time a transformation into a gas with a reduced amount of hazardous matter may take place. Also, the heat withdrawn from the gas in the secondary incineration chamber is of advantage to the low-temperature carbonization process because the heating gas of the low-temperature carbonization device is heated up in the secondary incineration chamber, the heating-up taking place in a closed-loop cycle between the low-temperature carbonization device and the heat exchanger of the secondary incineration chamber, thus avoiding corrosion of the parts.

German Patent DE-OS No. 35 04 810 discloses a process for the thermal transformation of dioxin. In this patent it is described in respect to a coke battery which is arranged parallel to a pyrolysis plant and the battery in the plant exchanges gas into a secondary incineration chamber which is apparently provided for the burning of a dioxin beyond a temperature of 1200° C. Such an arrangement is distinct from the present arrangement wherein the heating gas of a low temperature carbonization plant is led through a closed loop cycle to the low temperature carbonization device and the heat exchanger of the secondary incineration chamber. With applicant's invention which relates primarily to waste treatment the heating device for the low carbonization of the waste material is kept substantially corrosion free. This is achieved because the heating gases are circulated back to a separate heat exchanger. Thus, it is apparent that the present invention is basically dissimilar from a pyrolysis plant in which a gas converter of a coke bed is used to feed the burner of a heating gas generator after a gas purification.

Accordingly it is an object of the invention to provide an improved method of treating waste material which comprises subjecting the waste material to a heating in a closed container used in a heating gas which is circulated in heat exchange relationship with the chamber and effects a low temperature carbonization of the waste material and thereafter circulating the heating gas to a separate heat exchanger to maintain the heating gas at a temperature of over 1200° C. for from 1 to 5 sec. and then circulating it back to the closed container.

A further object of the invention is to provide a device for effecting waste treatment which includes a low temperature vessel having a waste treatment chamber through which waste material is passed in order to be carbonized and which includes a container around the chamber for the passage of a heating gas for heating the waste material in the container treatment chamber and which also includes a secondary treatment chamber which includes a heat exchanger having a heat exchange passage connected to the container and providing a close circulation of the heating gas from the container to the secondary treatment chamber and back again in a closed loop cycle.

A further object of the invention is to provide a waste treatment system which is simple in design, rugged in construction and economical to manufacture.

The various features of novelty which characterize the invention are pointed out with particularity in the claims annexed to and forming a part of this disclosure. For a better understanding if the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
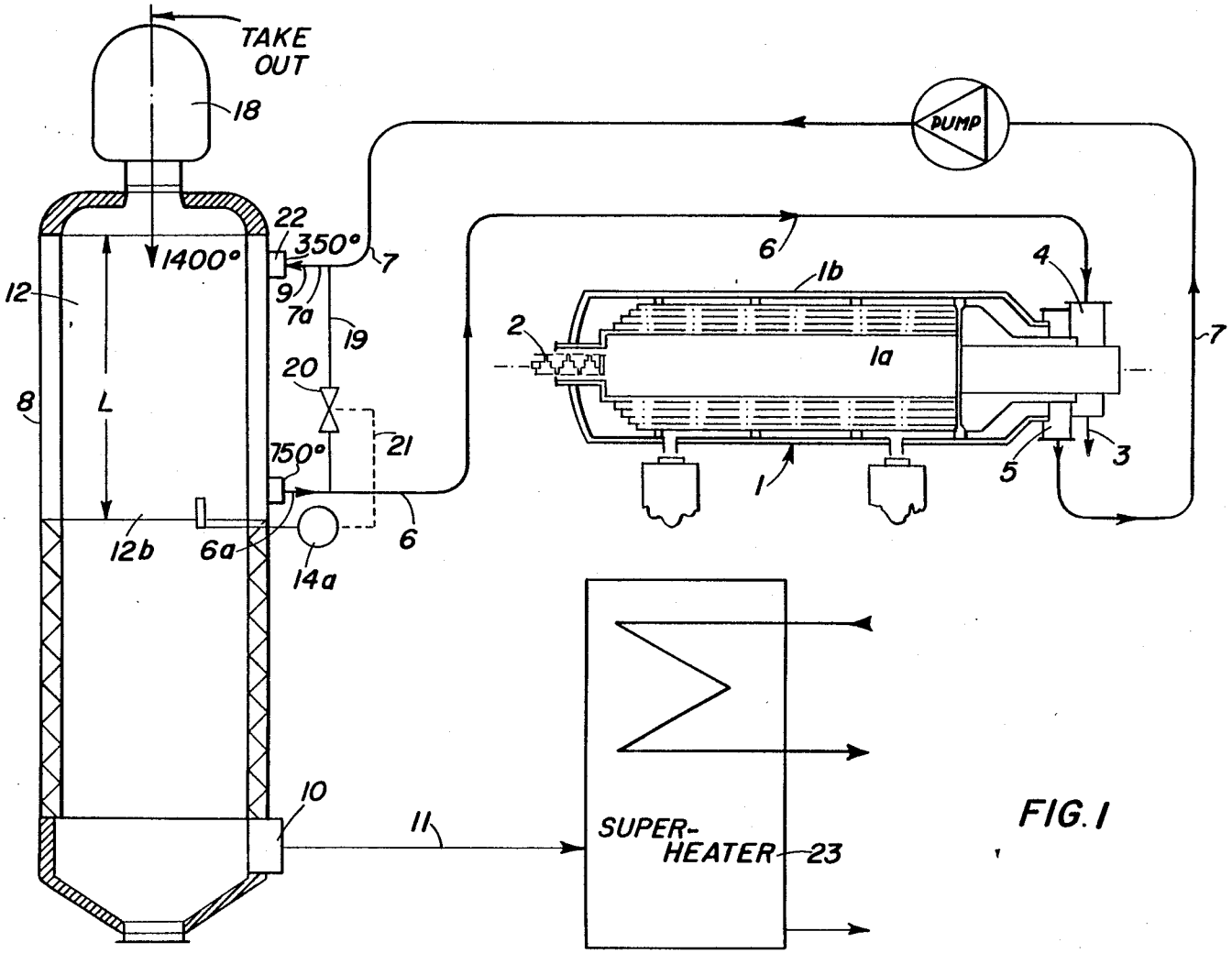
FIG. 1 is a schematic diagram of a low-carbonization device and a secondary incineration chamber constructed in accordance with the invention.
Figure 2:
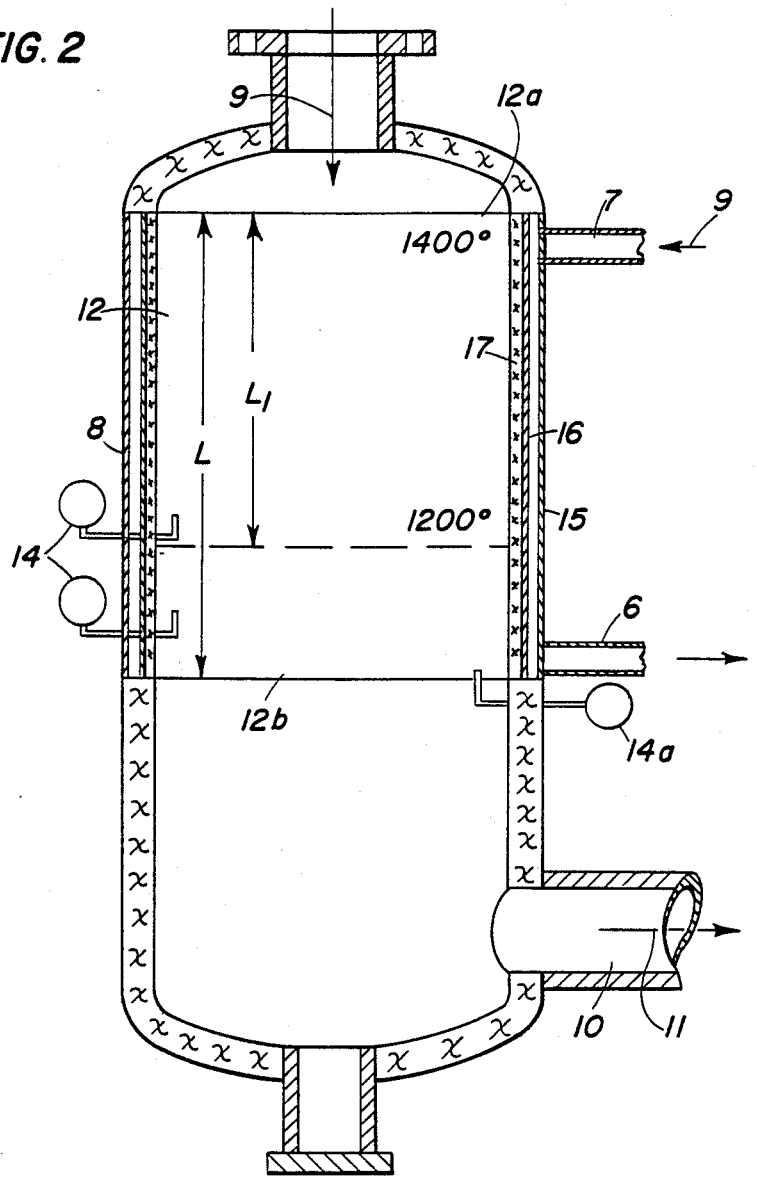
FIG. 2 is a vertical sectional view of the secondary incineration chamber

Referring to the drawings in particular, the invention embodied therein comprises a method of treating waste material which comprises subjecting the waste material to a heating in a closed container chamber la of a low carbonization device generally designated In accordance with the invention in order to heat the waste material in the low carbonization device 1 a waste gas or heating gas is passed through a passage in a containment or vessel 1b. Thereafter the heating gas is circulated to a separate secondary incineration device designated 8. The secondary device or chamber 8 includes a heat exchanger 12 which is regulated to maintain the gas above 1200° C. for a period of from 1 to 5 sec. The heating gases are circulated in a closed loop through a duct and a duct 7 as indicated in FIG. 1 of the drawings.

A low carbonization drum serves as the low carbonization device 1, which is fed the material to below-carbonized via a screw-conveyor 2, the low-carbonized material leaving the drum in the direction of the arrow 3. The heating gas required for the low-carbonization process reaches the drum via the supply line 4 and is led away via the duct 5.

The low-carbonization device 1 is connected through the ducts 6 and 7 to the secondary incineration device 8 standing upright in a preferred embodiment The burner gases charged with hazardous matter coming either from the low-carbonization drum or from another source reach the secondary incineration device in the direction of the arrow 9 and leave it through the outlet 10 in the direction of the arrow 11.

A heat exchanger 12 is arranged in an upper portion of the secondary incineration device 8. The duct 7 feeds gas into the heat exchanger, preferably an inert gas or the like, which arrives from the low-temperature carbonization device 1 and is fed back into the low-carbonization device via the duct 6, thereby forming a closed-loop cycle including the low-carbonization device, the ducts 6 and 7 and the heat exchanger 12. Thus, the susceptibility to corrosion is reduced considerably.

The gases of the secondary incineration chamber 8 enter the upper end 12a of the heat exchanger 12 in the direction of the arrow 9 at a temperature of 1400° C. They have a velocity of flow of about 2 to 4 m/sec., so that the period of dwell of the gases in the secondary incineration chamber, taking into account the diameter of the heat exchanger, is from 1 to 5 sec., preferably 2 sec. The length (or height) L of the heat exchanger 12 is chosen so that at a given velocity of the gases in the secondary incineration chamber, the period of dwell of 12 to 5 sec. inside the heat exchanger is guaranteed. Although the temperature of the gas may drop to 1200° during the passage it is more important that the period of dwell of 1 to 5 sec., preferably 2 sec. is maintained. Hence, the dimension L of the heat exchanger and the velocity of flow of the gases are chosen so that the parameters for the period of dwell and temperature are maintained. During this time the secondary incineration chamber gases which are hazardous to the environment are transformed into gases containing a reduced level of hazardous matter.

For the control of the temperature in the different sections of the heat exchanger, temperature meters 14 are advantageously installed. A lowermost temperature meter 14a is installed in the bottom section 12b of the heat exchanger 12. The heat exchanger comprises a cylindrical ring element with an outer wall 15 and an inner wall 16, the inner wall 16 having a lining 17 on which aggressive components of the secondary incinerator gases can run down.

As the temperature of the gases moving from the incineration chamber 18 in direction of the arrow 9 into the secondary incineration chamber may vary, and as a certain period of dwell in the heat exchanger 12 is to be guaranteed at a certain velocity of flow, the by-pass line 19 with a control valve 20 is installed between the two lines 6, 7, preferably near the secondary incineration chamber 8. The control valve 20 is preferably connected to the temperature meter 14a by means of a control line 21. If the temperature meter 14a indicates that the temperature in the bottom section 12b has falled below 1200° C., the valve 20 leads a part of the inert gas of the duct part 6a via a by-pass line 19 into the duct part 7a and the inlet 22 of the heat exchanger 12 and it mixes with the heating gases from the low-temperature carbonization device arriving via the duct 6 at a temperature of ca. 350° C. Herein the temperature in the inlet 22 of the heat exchanger 12 is increased, so that in the end a temperature of 1200° C. can be maintained even in the bottom section 12b of the heat exchanger. Therefore the control via the by-pass and the valve 20 guarantees that a temperature of 1200° C. or more is maintained for the length L of the heat exchanger 12 at a period of dwell of preferably 2 sec. in order to achieve a transformation of gases hazardous to the environment into those with a reduced content of hazardous matter. The gases with a reduced content of hazardous matter leave the secondary incineration chamber via the duct 11 and may be used in a downstream superheater 23.

The construction of the inner wall 16, and especially of its lining 17 is of particular importance. It has to guarantee that the temperature of the burner gases is maintained at or over 1200° C. for the period of dwell of 1 to 5 sec., while a median temperature of 550° C. (temperature at the inlet 7 of 350° C., at outlet 10 of 750° C.) is maintained in the heat exchanger, i.e. between the walls 15 and 17. The material and the thickness of the lining, which is preferably applied after the Torkret method have to be chosen accordingly. The control through the by-pass 19 can be employed to counterbalance the effects of a possible lessening of the effectivity of the lining with age in order to guarantee an exact temperature during the given period of dwell of the burner gases in the heat exchanger 12.

What is claimed is:

1. An apparatus for the low-temperature carbonization of waste materials, comprising a low-temperature carbonization device comprising an incinerator housing, heating gas circulating means for feeding a heating gas into closed heating engagement with said incinerator housing so as to carbonize the waste material, a secondary incinerator with a heat exchanger having a chamber connected to said heating gas circulating means so that the heating gas of said low-temperature carbonization device is led in a closed loop cycle through said low-temperature carbonization device and said heat exchanger, said heat exchanger having a wall means with a temperature maintaining lining which provides a temperature of the heating gas in said heat exchanger of at least 1200° C. for a duration of at least 1 to 5 sec.

2. An apparatus according to claim 1, wherein said heating gas is led through said low-temperature carbonization device and said heat exchanger of said secondary incineration chamber in a closed loop cycle, said heat exchanger being integrated in the wall of said secondary incineration chamber.

3. An apparatus according to claim 1, wherein said heat exchanger has an upper heat duct inlet and a bottom delivery line and including a control valve in between said upper heat duct inlet and said delivery line.

4. An apparatus according to claim 3, wherein said control valve includes a temperature meter.

5. A waste treatment system, comprising a low carbonization device having a waste treatment chamber through which waste material to be carbonized is passed, a containment around said chamber for the passage of a heating gas in heat exchange relationship with said waste material for carbonizing it, a secondary treatment chamber including a heat exchanger having a heating gas passage connected to said containment and providing a closed circulation of the heating gas from said containment to said secondary treatment chamber and back again in a closed loop cycle, and means associated with said secondary treatment chamber for maintaining the heating gas therein for at least from 1 to 5 sec. at a temperature of over 1200° C.

6. A method of treating waste material, comprising subjecting the waste material to a heating in a closed container using a heating gas circulated in heat exchange relationship with the waste material at a temperature to carry out a low-temperature carbonization of the waste material, and thereafter circulating the heating gas to a separate heat exchanger to maintain the heating gas at a temperature of at least 1200° C. from 1 to 5 sec. and then returning it to said closed container.

* * * * *